United States Patent [19]

Daley, Jr. et al.

[11] Patent Number: 4,494,813

[45] Date of Patent: Jan. 22, 1985

[54] ELECTRIC CONNECTOR ASSEMBLY

[75] Inventors: Eugene E. Daley, Jr.; Thomas R. O'Grady, both of Fort Wayne, Ind.

[73] Assignee: Carrier Corporation, Syracuse, N.Y.

[21] Appl. No.: 476,170

[22] Filed: Mar. 17, 1983

[51] Int. Cl.[3] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 2,931,006 | 3/1960 | Klumpp, Jr. | 339/198 |
| 3,012,219 | 12/1961 | Levin et al. | 339/98 |
| 3,082,397 | 3/1963 | Clarkson et al. | 339/157 |
| 3,380,013 | 4/1968 | Krone et al. | 339/97 |
| 3,391,383 | 7/1968 | Antes | 339/174 |
| 3,680,035 | 7/1972 | Teagno et al. | 339/59 |
| 3,720,907 | 3/1973 | Asick | 339/176 |
| 3,789,344 | 1/1974 | Brorein et al. | 339/53 |
| 3,804,971 | 4/1974 | Bazille, Jr. | 174/88 |
| 3,958,857 | 5/1976 | Schultz et al. | 339/128 |
| 3,963,319 | 6/1976 | Schumacher et al. | 339/176 |
| 4,025,142 | 5/1977 | Huber et al. | 339/128 |
| 4,138,184 | 2/1979 | Knopp | 339/97 |
| 4,171,858 | 10/1979 | Knowles et al. | 339/99 |
| 4,191,442 | 3/1980 | Caveney et al. | 339/99 |
| 4,293,177 | 10/1981 | Weisenburger | 339/99 |
| 4,344,664 | 8/1982 | Walkup | 339/99 R |
| 4,426,125 | 1/1984 | Crawford | 339/99 R |

*Primary Examiner*—Joseph H. McGlynn

*Attorney, Agent, or Firm*—Robert D. Sommer

[57] ABSTRACT

An electric connector assembly for connecting insulated wires to conductors on a printed circuit board comprises a housing block of insulation material for each pair of wires. Each housing block is formed with two chambers separated by divider wall means which include a flexible retaining arm projecting from the base of the housing block for insertion through a hole in the printed circuit board into retaining engagement therewith. An insulation displacement contact member is disposed in each chamber with a terminal lug portion extending from the base of the housing block for insertion into the printed circuit board. A cover hinged to each housing block has integral pusher members for forcing a pair of wires into respective slotted contact plates of the associated contact members when the cover is moved to a closed position upon the housing block.

4 Claims, 15 Drawing Figures

FIG. 8
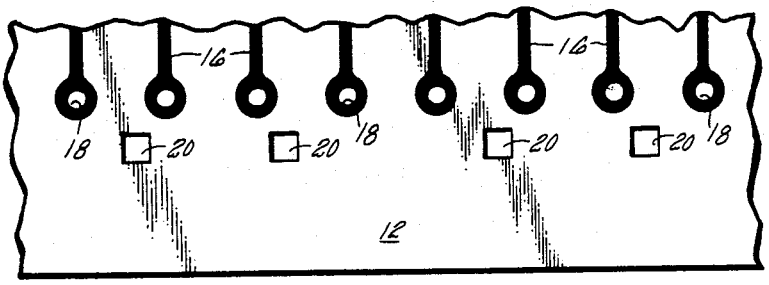
FIG. 9
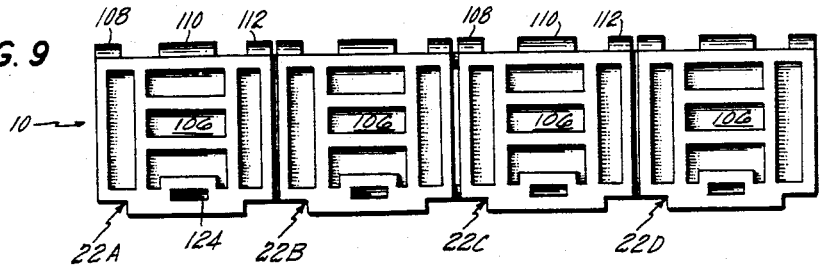
FIG. 10
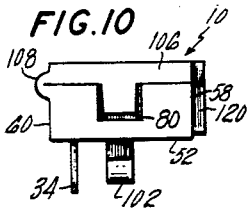
FIG. 11
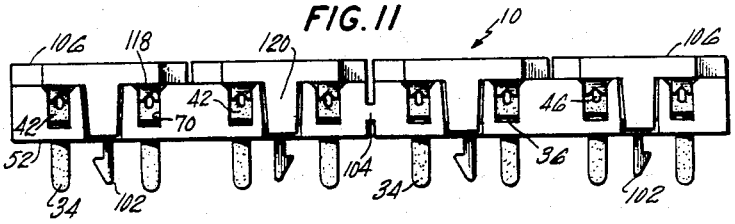
FIG. 12
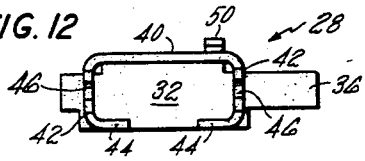
FIG. 13
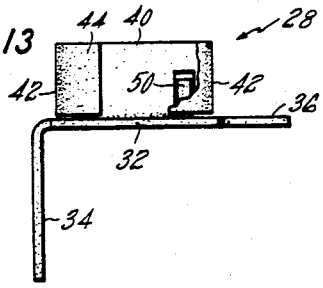
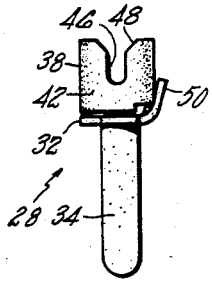
FIG. 14
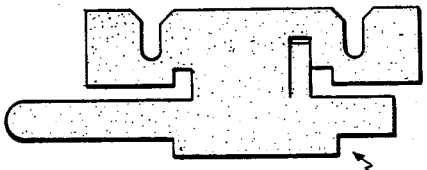
FIG. 15

ELECTRIC CONNECTOR ASSEMBLY

BACKGROUND OF THE INVENTION

This invention relates to an improved electric connector assembly for making rapid electrical connections of insulated wires to a plurality of conductors on a printed circuit board or the like.

Various control devices such as the thermostat control modules of heat pump and furnace equipment commonly employ printed circuit boards provided with terminal blocks for connection to external insulated wires by installers of the equipment. With terminal blocks of the conventional type, the end of each wire must be stripped of insulation and bent in a loop before it is clamped by the head of a binding screw. Because of the time consumed and resulting cost in making such wire connections, it would be advantageous to employ a low cost connector assembly readily mountable upon a printed circuit board and suitable for making rapid electric connections to unstripped insulated wires.

A variety of insulation piercing electric terminals which can be connected to an insulated wire without stripping of the wire insulation are known. One type of insulation piercing terminal shown, for example, in U.S. Pat. Nos. 3,012,219, 3,380,013, 3,804,971, 4,138,184, 4,171,858 and 4,191,442 comprises at least one thin slotted plate which is forced through the wire insulation into conductive engagement with the core of the wire. Although the connector assemblies disclosed in the foregoing patents are not particularly suited for use with a printed circuit board, various other types of connector assemblies which may be mounted on a printed circuit board or the like are known as shown by U.S. Pat. Nos. 3,391,383, 3,680,035, 3,720,907, 3,958,857, 3,963,319, 4,025,142 and 4,293,177. U.S. Pat. No. 3,789,344 as well as the previously cited U.S. Pat. Nos. 3,391,383, 3,680,035 and 4,135,184 each discloses a connector body of the clamshell type wherein a housing and a cover are hinged together and include latch means for holding the cover closed. A continuous strip of interconnected connector housing blocks which may be divided into smaller segments if desired are disclosed in U.S. Pat. Nos. 2,931,006 and 3,082,397.

SUMMARY OF THE INVENTION

The improved connector assembly of the present invention likewise makes use of thin slotted contact plates carried by the housing block of a clamshell type body which may be interconnected to a like body by frangible web portions. The housing block is formed with two chambers separated by divider wall means which include a flexible retaining arm projecting from the base of the housing block for insertion through a hole in a printed circuit board into retaining engagement therewith. A contact member comprising a pair of slotted contact plates in spaced opposed relation is disposed in each chamber and has a terminal lug portion extending from the base of the housing block for insertion into the printed circuit board. A cover hinged to the housing block has integral pursher members for forcing a pair of wires into respective slotted contact plates of the associated contact members when the cover is moved to a closed position where it latches with the housing block. The connector assembly is compact in size, of a low manufacturing cost and is particularly suited for quick and easy connection to insulated wires such as solid thermostat wires after being installed on a printed circuit board.

For a better understanding of the invention, reference may be had to the following detailed description taken in connection with the accompanying drawings, in which:

BRIEF DESCRIPTION OF THE DRAWINGS

FIG. 8 is a fragmentary plan view of the underside of the printed circuit board shown in FIG. 1 prior to mounting of the connector assembly unit thereon;

FIG. 9 is a plan view of the connector assembly unit of FIG. 1 with the covers closed;

FIG. 10 is a side elevational view of the structure of FIG. 9;

FIG. 11 is a front elevational view of the structure of FIG. 9;

FIG. 12 is a plan view of one of the contact members employed in the connector assembly unit of FIG. 1;

FIG. 13 is a side elevational view of the contact member of FIG. 12;

FIG. 14 is an end elevational view of the contact member of FIG. 12; and FIG. 15 is a plan view of the flat blank from which the contact member of FIG. 12 is formed.

DESCRIPTION OF THE PREFERRED EMBODIMENT

Figure 1:
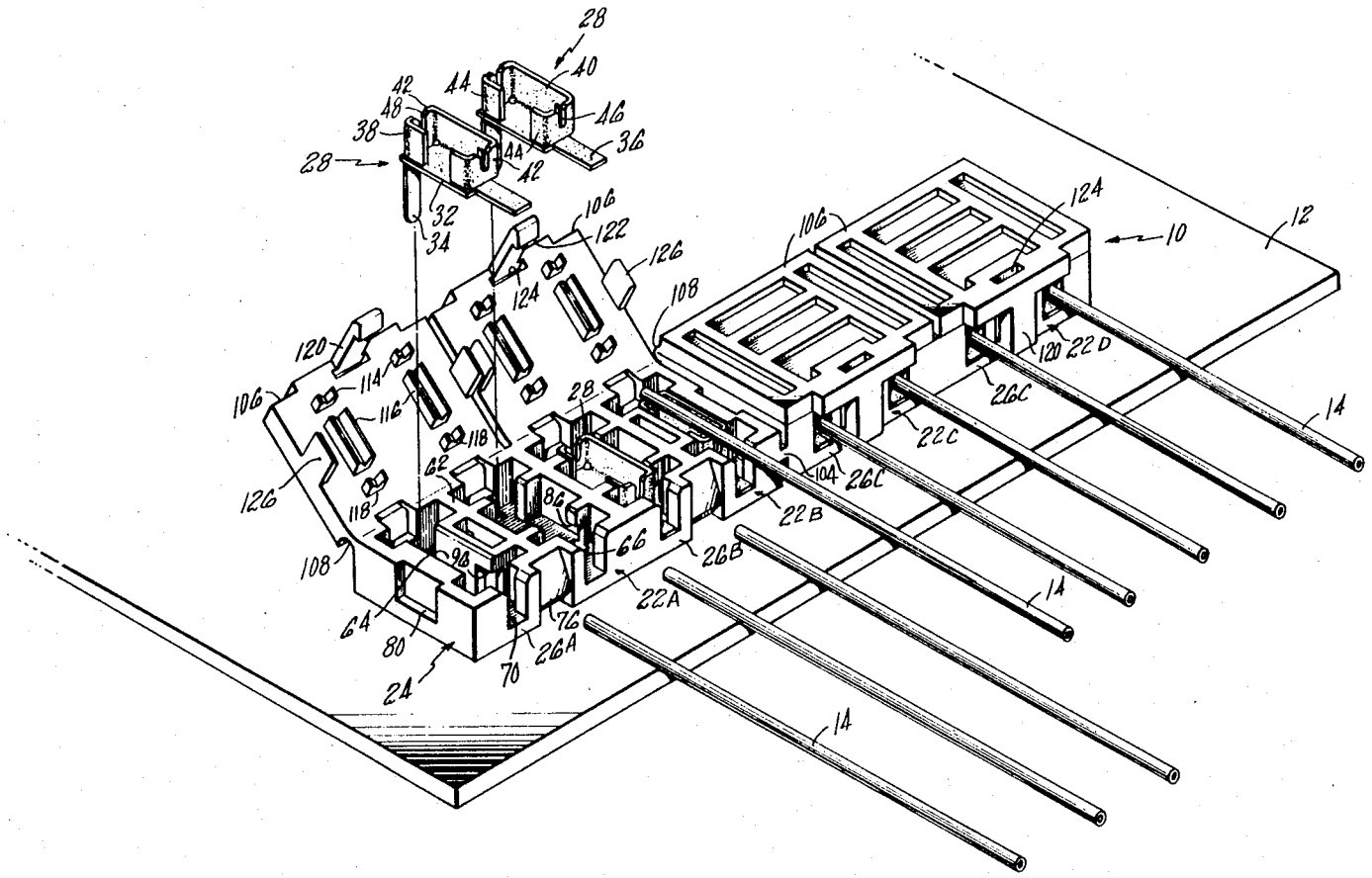
FIG. 1 is a perspective view, partially exploded, of an electric connector assembly unit in accordance with the present invention mounted on a printed circuit board with two covers in open positions relative to associated housing blocks and the contact members from one housing block separated therefrom and showing insulated wires to be connected to the unit.
Figure 2:
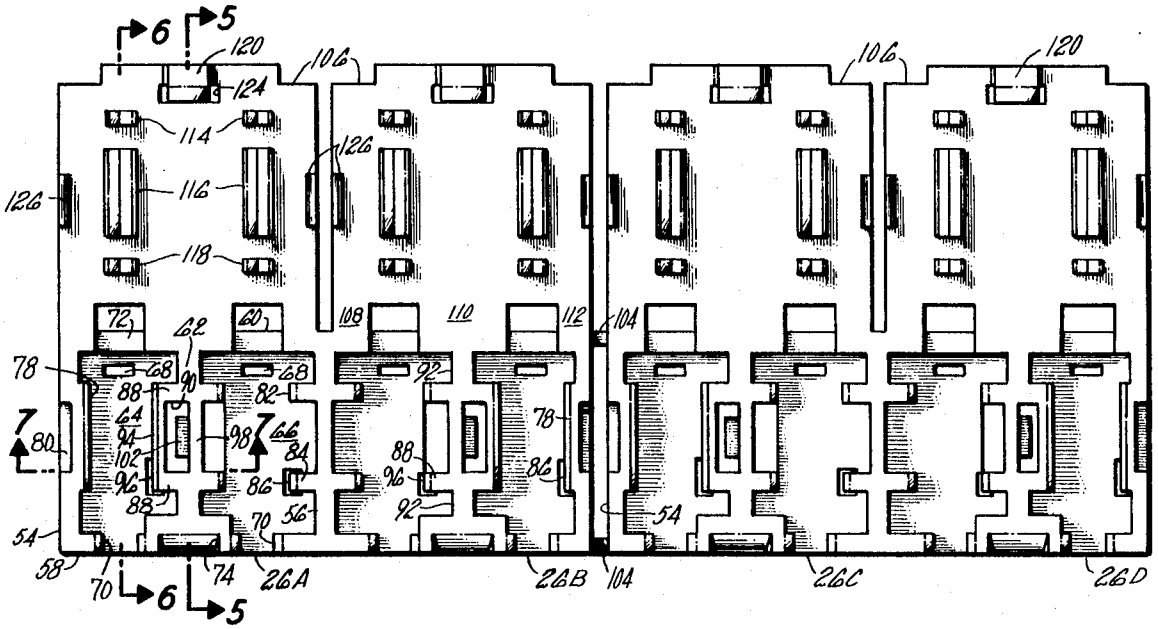
FIG. 2 is a plan view of the housing and its covers employed in the electric connector assembly unit of FIG. 1 prior to reception of the contact members and closing of the covers.
Figure 3:
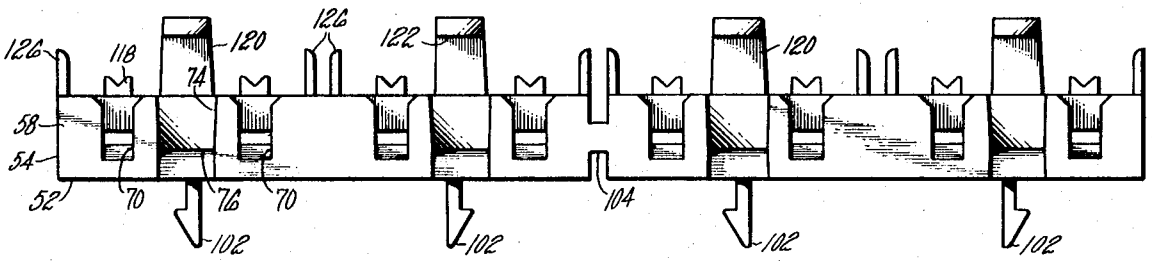
FIG. 3 is a front elevational view of the housing and covers of FIG. 2.
Figure 4:
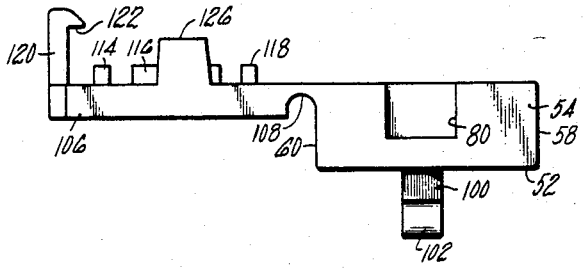
FIG. 4 is a side elevational view of the housing and covers of FIG. 2.
Figure 5:
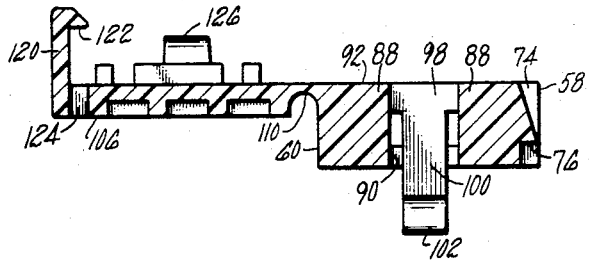
FIG. 5 is a sectional view taken along line 5—5 of FIG. 2.
Figure 6:
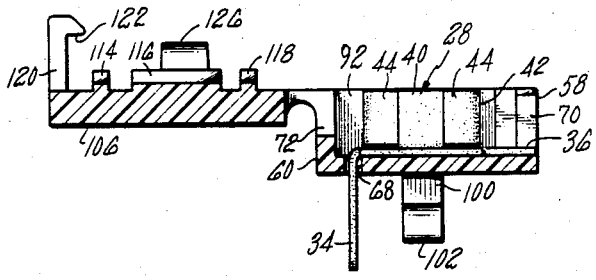
FIG. 6 is a sectional view taken along line 6—6 of FIG. 2 showing a contact member inserted in a housing block.
Figure 7:
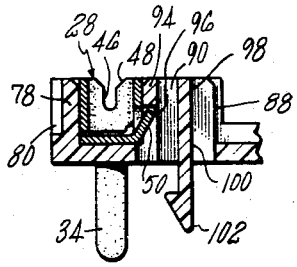
FIG. 7 is a sectional view taken along line 7—7 of FIG. 2 showing a contact member inserted in a housing block.

FIG. 1 shows an electric connector assembly unit 1 in accordance with the present invention which is mounted on a printed circuit board 12 for connecting a plurality of insulated wires 14 to conductors 16 on the printed circuit board 12. As shown in FIG. 8, the ends of the conductors 16 terminate at apertures 18 which are arranged in a straight row. A row of holes 20 are also formed in the board 12 adjacent the row of apertures 18. The connector assembly unit 10 comprises four similar connector assemblies 22A, 22B, 22C, 22D with a common housing 24 of resilient insulation material such as nylon formed to provide four respective open top hollow housing blocks 26A, 26B, 26C, 26D which carry corresponding pairs of contact members 28.

The contact members 28 are each formed from a single blank, generally indicated at 30 in FIG. 15, which is, in turn, stamped from thin conductive sheet metal such as tin-plate brass 0.142 mm. thick. Each contact member 28 comprises a flat base portion 32 with a terminal lug portion 34 extending perpendicularly from one edge thereof and a tab portion 36 extending longitudinally from the opposite edge. Each contact member 28 also includes a wire terminating portion 38 which comprises an upstanding side member 40 extending perpendicularly from a side edge of the base portion 32 and having opposed free marginal end portions bent inwardly in the same direction to define a pair of contact plates 42 in spaced opposed relation. The contact plates 42 have respective free ends or flanges 44 which are directed toward each other to define a partial side member opposite the side member 40 and to stiffen the contact plates 42. An insulation displacing, wire-receiving slot 46 formed in each contact plate 42 has a flared mouth 48 opening into an edge thereof facing away from the base portion 32. The slots 46 are aligned with one another and are adapted to make insulation piercing contact with a wire 14 upon movement of the insulated wire laterally of its axis into the aligned slots 46. A resilient retaining tang 50 is partially struck out from the side member 40 and extends obliquely therefrom in a direction away from the base portion 32.

Referring now principally to FIGS. 2–7, the housing block 26A comprises a flat base 52, a pair of opposed side walls 54 and 56, a front wall 58, a rear wall 60 and divider wall means 62 extending between the walls 58 and 60 to define two longitudinally extending chambers 64 and 66. A contact member 28 is positioned in each of the chambers 64 and 66 with the contact plates 42 facing the front and rear walls 58 and 60, respectively.

The base 52 has a flat bottom or outer surface adapted for engagement with the top of the printed circuit board 12 and has bores 68 therein to receive terminal lug portions 34 which extend beyond the bottom surface of the base 52 for insertion into respective apertures 18 of the printed circuit board 12. The front wall 58 is provided with a pair of notches 70 each extending from the upper edge thereof to the base 52 for receiving a tab portion 36 when a contact member 28 is fitted in each of the chambers 64 and 66. The rear wall 60 is also provided with a pair of notches 72 opening into an upper edge thereof, each notch 72 being in alignment with a corresponding one of the notches 70 in the front wall 58 and the slots 46 of a respective one of the contact members 28. Accordingly, an insulated wire 14 placed in the top entrances of one set of aligned notches 70 and 72 is positioned for subsequent insertion into the slots 46 of the associated contact member 28. Intermediate the notches 70 the front wall 58 is formed with an outwardly facing channel 74 having a transverse shoulder 76 extending thereacross.

The side of the chamber 64 facing the divider wall means 62 includes a projection 78 formed by an inwardly offset section of the side wall 54 which also defines an outer depression 80. The side of the chamber 66 facing the divider wall means 62 includes two projections 82 and 84 in the form of spaced ribs projecting from the side wall 56. The projection 84 is undercut or recessed to define a locking shoulder 86 facing the base 52. The divider wall means 62 include two transverse abutment walls 88 extending perpendicularly from the base 52 at opposite sides of a centrally located opening 90 in spaced relation to each other. Each of the abutment walls 88 is integral with a longitudinal branch wall 92, one of the branch walls 92 being connected to the front wall 58 and the other being connected to the rear wall 60. A longitudinal barrier wall 94 is integrally connected at its opposite ends to the abutment walls 88 in opposed relation to the projection 78 and has a recess or opening therein at one end defining a locking shoulder 96 facing the base 52. A longitudinally extending L-shaped rail 98 is supported at its ends in spaced relation to the base 52 by the abutment walls 88. A flexible arm 100 integral at one end with the rail 98 projects downwardly through the opening 90 in the base 52 and has an enlarged free end 102 disposed below the base 52. The arm 100 is centrally located within the opening 90 such that its free end 102 can be flexed laterally with respect to the base 52. The free end 102 of the arm 100 is adapted for insertion into a hole 20 of the printed circuit board 12 when the base 52 is brought into contacting relations with the board 12. The laterally outwardly projecting extension defined by the enlarged end 102 of the arm 100 provides an upwardly facing shoulder for engagement with the underside of the printed circuit board 12 to retain the housing block 26A on the board 12.

The housing block 26B is substantially a mirror image of the housing block 26A along an upright plane extending longitudinally through the side wall 56 with that side wall being common to both housing blocks 26A and 26B. The block 26B, however, differs from the block 26A in that the projection 78 of the block 26B is recessed at one end to define a locking shoulder 86 and the forward abutment wall 88 is undercut to define a locking shoulder 96. The housing blocks 26C and 26D are substantially identical to the housing blocks 26A and 28B, respectively. A pair of frangible web portions 104 connects the adjoining side walls 54 of the blocks 26B and 26C and can be readily broken to separate one pair of blocks 26A and 26B from the other pair of blocks 26C and 26D.

Each of the connector assemblies 22A, 22B, 22C, 22D further comprises a cover 106 connected to the rear wall 60 of the respective housing blocks 26A, 26B, 26C, 26D by three flexible hinges 108, 110, 112. The covers 106 and the hinges 108, 110, 112 are integrally molded with the housing 24 in the open condition shown in FIG. 2. The covers 106 may be individually folded over the open tops of the housing blocks 26A, 26B, 26C, 26D to extend across the respective bases 52 thereof in closed positions illustrated in FIG. 1. Each cover 106 is formed with a first set of longitudinally aligned pusher members 114, 116, 118 extending uprightly from its undersurface and a second set of longitudinally aligned pusher members 114, 116, 118 extending uprightly from the undersurface adjacent the first set. Each set of pusher members is arranged to bear against a wire 14 and drive the wire 14 into the aligned slots 46 of an associated contact member 28 when the cover is moved to its closed position. For latching the covers 106 in their closed positions, a deflectable latching post 120 extends from the undersurface of each cover 106 and has an upwardly facing shoulder 122 engageable with the shoulder 76 of the complementarily formed channel 74 in an associated front wall 58. A slot 124 located in each cover 106 directly over the shoulder 122 of a latching post 120 provides an opening in which a small screw driver blade may be inserted for flexing the latching post outwardly to thereby unlatch the cover 106 from its respective housing block. Each cover 106 is also formed with centering lugs 126 at opposite sides of its undersurface which extend respectively into the depression 80 of a side wall 54 and the inner recess defined by the projections 82 and 84 of a side wall 56.

The contact members 28 are inserted into the respective chambers 64 and 66 of the housing blocks 26A, 26B, 26C, 26D prior to mounting of the connector assembly unit 10 on a printed circuit board 12. Upon completion of insertion of a contact member 28 into one of the chambers 64 and 66, its outwardly bent tang 50 engages one of the locking shoulders 86 and 96 thereby locking the contact member 28 in place.

The connector assembly unit 10 is placed on the printed circuit board 12 by aligning the terminal lug portions 34 of the contact members 28 with the apertures 18 in the board 12 and pressing the unit 10 toward the board 12. After initial entry of the terminal lug portions 34 into the apertures 18, engagement of the free ends 102 of the arms 100 with the sides of the respective holes 20 in the board 12 resiliently flexes the arms 10 until the free ends 102 pass through the holes 20. The arms 100 then return toward their normal positions with the free ends 102 seated against the underside of the board 12 thereby securing the unit 10 to the board 12. The ends of the terminal lug portions 34 protruding from the apertures 18 may be wave soldered to the portions of the conductors 16 surrounding the respective apertures 18.

In typical use, the printed circuit board 12 with the connector assembly unit 10 mounted thereon is installed on the wall of some device or some other support. With the covers 106 in their open positions, the ends of the wires 14 to be connected to the board conductors 16 are positioned over the contact members 28 with each wire lying in a respective pair of aligned notches 70 and 72. When the covers 106 are moved to their closed positions, the pusher members 114, 116, 118 of each cover 106 simultaneously presses two wires 14 into the respective pairs of aligned slots 46 of the associated contact members 28. The edges of the slots 46 pierce or slice through the insulation of each wire 18 to resiliently engage opposite sides of the cores of the wires and thereby establish electrical contact with the wire cores. Upon full closure of each cover 106, the latching post 120 thereof enters the channel 74 in the associated front wall 58 to latch under the shoulder 76 so that the cover 106 is retained in its closed position.

The connector assembly unit 10 is particularly suited for the connection of solid No. 18AWG thermostat wire and may be conveniently manufactured in small sizes. For example, a typical eight-circuit connector assembly unit 10 in accordance with the preceding description has overall principal dimensions in closed form of about 6.0 by 1.5 by 0.65 centimeters. It will be apparent that an even smaller two-circuit form of the connector assembly unit (not shown) may be used for making connections to a single pair of wires. From the foregoing, it will also be seen that the connector assembly unit of the present invention is of a relatively inexpensive construction which permits insulated wires to be quickly and easily connected by unskilled persons.

While there has been described above the principles of this invention in connection with a specific connector assembly unit construction, it is to be understood that this description is made only by way of example and not as a limitation to the scope of the invention.

What is claimed is:

1. An electric connector assembly for connecting two insulated wires to be conductors on a printed circuit board which comprises:

a conductive sheet metal contact member for each wire comprising a flat base portion, a wire terminating portion, and a terminal lug portion extending perpendicularly from said base portion on one side thereof for insertion into a printed circuit board; said wire terminating portion including a pair of contact plates supported on the other side of said base portion in spaced opposed relation; each contact plate having a wire-receiving slot opening into an edge thereof facing away from said base portion and aligned with the slot of the other contact plate whereby upon movement of an insulated wire laterally of its axis into said aligned slots, the edges of said slots pierce the insulation of the wire to establish electrical contact with the wire;

an open top hollow housing block of resilient insulation material comprising a flat base, front and rear walls, first and second side wall, and divider wall means extending between said front and rear walls to define two longitudinally extending parallel chambers each receiving a respective contact member with its contact plates facing said front and real walls respectively; said base having bores therein through which said terminal lug portions extend beyond the bottom surface of said base; said front and rear walls each having a pair of notches opening into an edge thereof facing away from said base in alignment with the respective slots of said contact plates for receiving the wires to be connected; said divider wall means including a longitudinally extending rail supported at its ends in spaced relation to said base by a pair of abutment walls formed integrally on said base at opposite sides of an opening through said base; a flexible arm integral at one end with said rail and having a free end laterally deflectable and projecting through said opening below the bottom surface of said base; said arm having a locking extension projecting laterally outwardly and adapted for insertion through a hole in a printed circuit board and into retaining engagement with the underside of the printed circuit board when said base is brought into contacting relation with the printed circuit board;

and a cover hinge on said rear wall to fold over and extend across said base in its closed position; said cover having integral pusher members for forcing wires into said slots of the contact plates when said cover is moved to its closed position; said cover and said front wall being complementarily formed with means for latching said cover in its closed position.

2. The electric connector assembly of claim 1 wherein said divider wall means and one of said side walls are each provided with a recess defining a locking shoulder; each of said contact members being stamped and formed from a single piece of thin conductive sheet metal; said terminal lug portion depending from said base portion at one end edge thereof; said wire terminating portion comprising an upstanding side member extending perpendicularly from a side edge of said base portion and having opposed free marginal portions bent inwardly in the same direction to define said pair of contact plates; said contact plates having respective free ends directed toward each other to define at least a partial side member opposite said upstanding side member; and a resilient tang partially struck out from said upstanding side member extending obliquely therefrom for engagement with a respective one of said locking shoulders to retain said contact member in its associated chamber.

3. An electric connector assembly unit for connecting a plurality of pairs of insulated wires to conductors on a printed circuit board which comprises a plurality of similar connector assemblies each as defined in claim 1, one for each pair of wires; the housing blocks of said connector assemblies being connected together in side-by-side relation with the bottom surfaces of their bases lying in a common plane.

4. An electric connector assembly unit according to claim 3 wherein two adjoining housing blocks are interconnected to one another by frangible web portions which may be broken to provide two separate connector assembly segments.

* * * * *